United States Patent [19]

Howell, Jr. et al.

[11] 4,381,861

[45] May 3, 1983

[54] OCTAGONAL TRAMPOLINE

[76] Inventors: William T. Howell, Jr.; Danny T. Howell; John T. Howell, all of Rte. 6, Box 39, Eastman, Ga. 31023

[21] Appl. No.: 331,522

[22] Filed: Dec. 17, 1981

[51] Int. Cl.[3] ..... A63B 5/18

[52] U.S. Cl. ..... 272/65; 108/155

[58] Field of Search ..... 272/65; 108/153–155; 248/188, 188.1, 440; 5/310, 316; 182/137–140, 181

[56] References Cited

U.S. PATENT DOCUMENTS 2,991,841 7/1961 Sampson et al. ..... 272/65

4,319,747 3/1982 Rogers ..... 272/73

4,336,933 6/1982 Appelbaum ..... 272/70

*Primary Examiner*—Richard C. Pinkham

*Assistant Examiner*—S. R. Crow

*Attorney, Agent, or Firm*—Newton, Hopkins & Ormsby

[57] ABSTRACT

A trampoline perimeter frame and the support legs for the perimeter frame are fabricated as identically sized and shaped members enabling the use of only one fabricating jig. Connecting elements hold the support legs rigidly in planes perpendicular to the plane occupied by the perimeter frame and resist relative rotation of the legs and perimeter frame. Strength, simplicity and economy of manufacture are achieved.

11 Claims, 6 Drawing Figures

OCTAGONAL TRAMPOLINE

BACKGROUND OF THE INVENTION

This invention has for its objective to improve the safety, convenience and strength of trampolines. More particularly, the invention seeks to provide a better trampoline support frame and leg structure which can be manufactured at less cost to produce a number of identical components which, in assembled relationship, form the perimeter frame of the trampoline and the supporting legs for such frame.

Another object is to provide connecting means between the legs and the several identical perimeter frame sections whereby these elements can be assembled with ease and without tools or separable fasteners, such as screws or pins, the connecting means serving also to strongly resist rotation between the support legs and the horizontal perimeter frame which they underlie.

Other features and advantages of the invention will become apparent during the course of the following detailed description.

DETAILED DESCRIPTION

Figure 1:
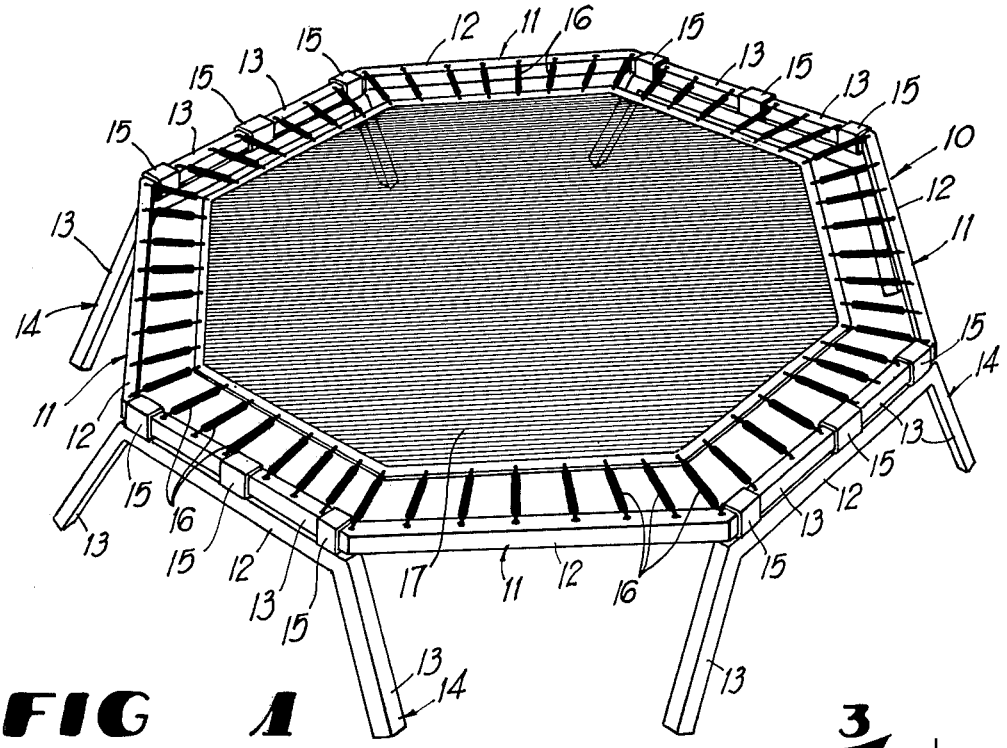
FIG. 1 is a perspective view of a trampoline constructed in accordance with the present invention.
Figure 2:
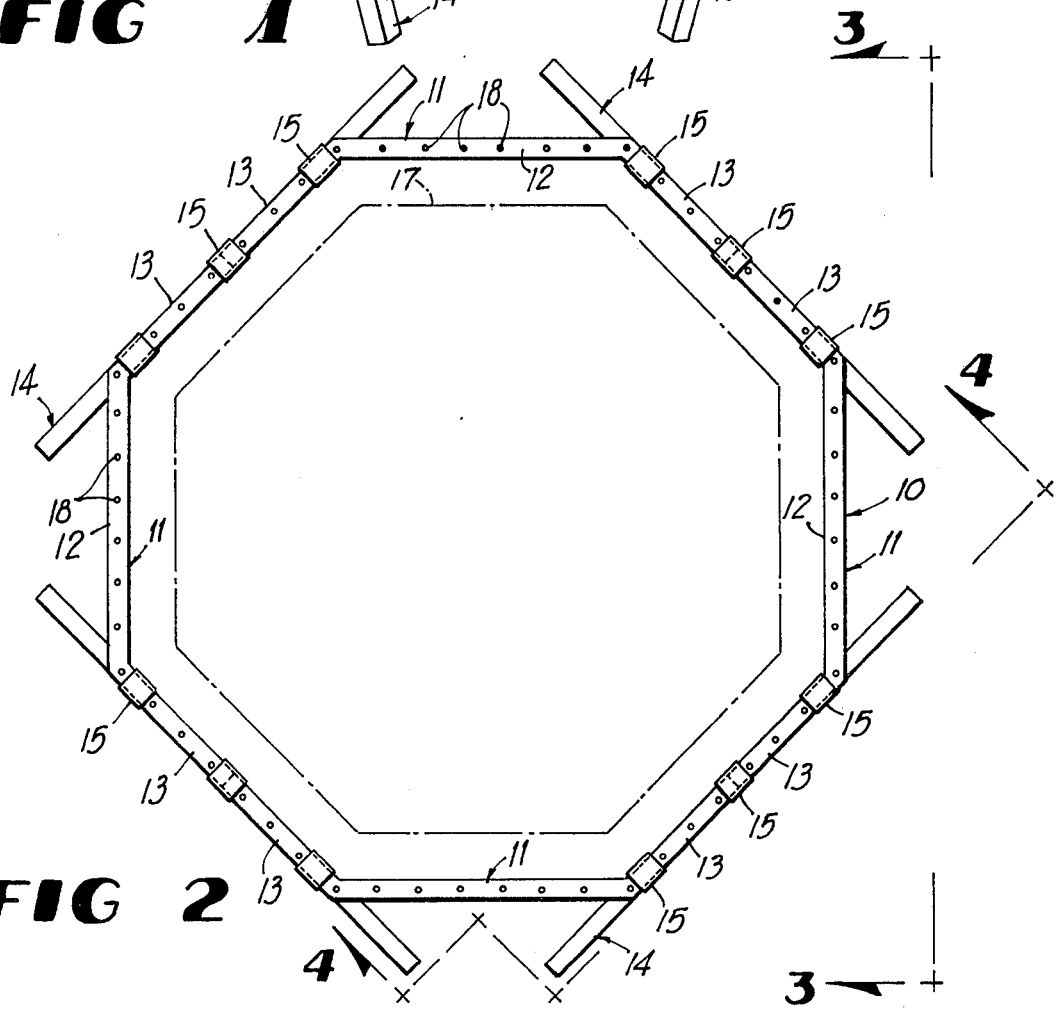
FIG. 2 is a plan view of the trampoline perimeter frame and support legs.
Figure 3:
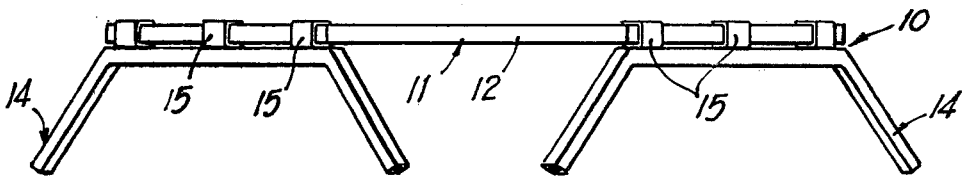
FIG. 3 is a side elevation taken on line 3—3 of FIG. 2.
Figure 4:
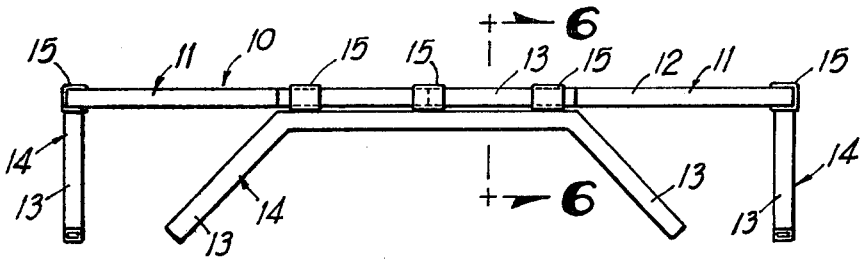
FIG. 4 is a similar view taken on line 4—4 of FIG. 2.
Figure 5:
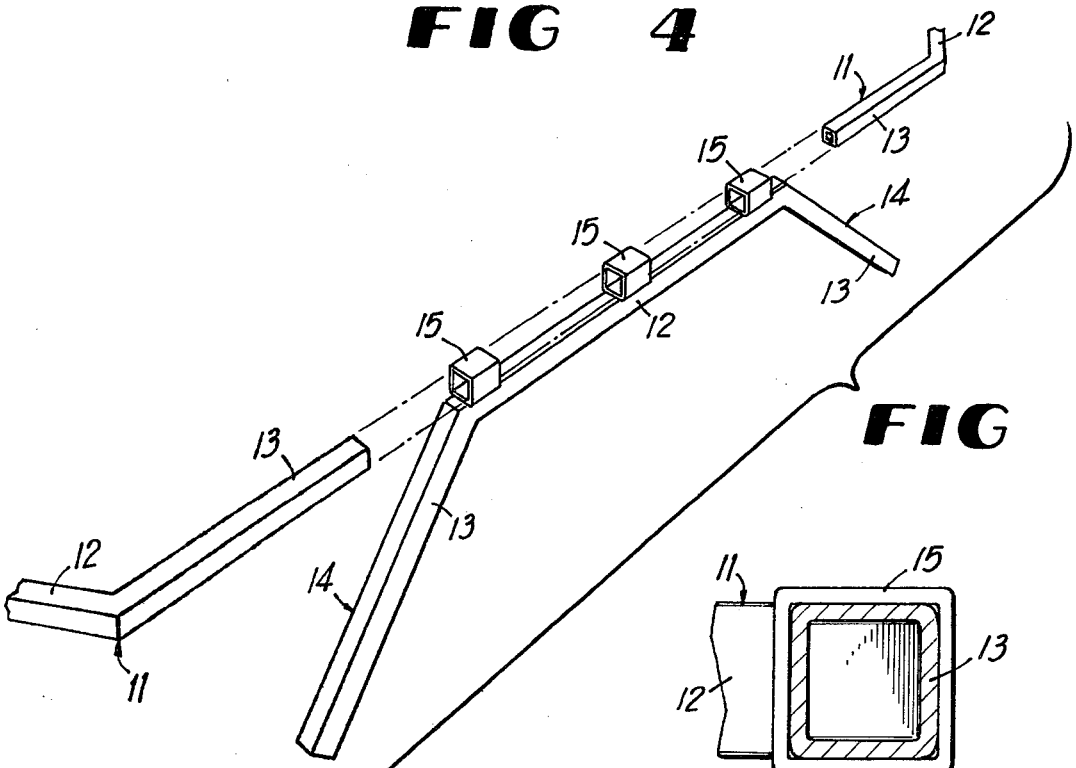
FIG. 5 is a fragmentary exploded perspective view showing one support leg, adjacent perimeter frame sections and connector means.
Figure 6:
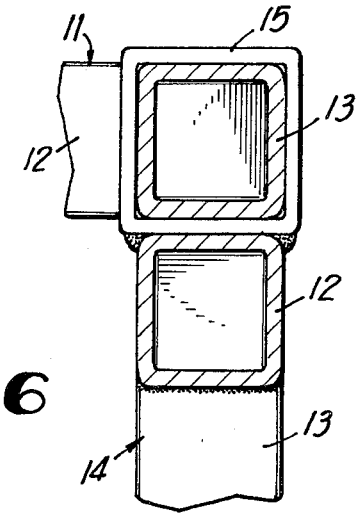
FIG. 6 is an enlarged vertical section taken on line 6—6 of FIG. 4.

Referring to the drawings in detail wherein like numerals designate like parts, a trampoline of octagonal form is illustrated. It should be understood that the invention is not limited to this particular shape and can be utilized in connection with other polygonal trampoline forms and also for a circular trampoline.

Continuing to refer to the drawings, the trampoline includes a perimeter frame 10 consisting of four identical quarter octagonal frame sections 11 each having an intermediate straight bar section 12 and two equal length divergent bar sections 13 of lesser length than the intermediate section 12. The identical quarter octagonal frame sections 11 are preferably formed of square cross section tubing, although in some cases other polygonal cross sections may be employed or round tubing having at least one flat wall portion thereon.

Four support legs 14 for the perimeter frame 10 are identical in size and configuration to the quarter frame sections 11, and therefore the same tooling can be employed to fabricate the quarter frame sections and legs, thus significantly reducing manufacturing costs and simplifying assembly of the trampoline. The tubing stock used for support legs 14 has the same cross section as the tubing used in the perimeter frame.

In accordance with an important and unique feature of the invention, connector sleeves 15 of matching cross section with the quarter octagonal perimeter frame sections 11 are sized to telescopically receive the straight bar sections 13 of adjacent perimeter frame sections 11 telescopically and coaxially. The three short coaxial connector sleeves 15 are welded to the intermediate bar section 12 of each identical support leg 14 at the ends and at the center of bar section 12, as shown. The lengths of bar sections 13 and the spacing of the sleeves 15 is such that when the bar sections 13 are inserted in the three connector sleeves on each support leg 14 their free ends will abut or meet at the center of the intermediate sleeve 15, as clearly shown in the drawings. No screws, pins or other like separable fasteners are required to assemble the trampoline frame. Once the bar sections 13 are snugly telescoped in the three connector sleeves 15 they will remain in place by friction and there is no tendency for them to pull out or separate because they are biased toward their assembled positions in a common horizontal plane by the action of the multiplicity of strong retractile springs 16 which are connected radially between the perimeter frame 10 and a trampoline mat 17 of generally conventional construction.

The perimeter frame sections 11 are drilled as at 18 to receive outer terminals of the many springs 16. The inner terminals of these springs are conventionally connected with the reinforced border of the mat 17 which conforms to the shape of the perimeter frame 10.

It can be seen that when the four quarter octagonal perimeter frame sections 11 are properly telescoped into the rigid sleeves 15 and biased in place by the springs 16, a continuous rigid octagonal perimeter frame of great strength for the trampoline is created. The sleeves 15 also serve simultaneously to rigidly connect the horizontal perimeter frame at plural points to the support legs 14, and the sleeves 15 hold these legs in vertical planes at right angles to the normal horizontal plane of the trampoline and strongly resist any rotation of the legs out of their vertical planes. This is a major improvement feature which cannot be adequately obtained by the use of set screws and the like.

The assembling of the trampoline is rendered very simple and substantially foolproof inasmuch as the quarter octagonal frame sections 11 are identical and the support legs 14 are also identical and are readily distinguishable at a glance from the frame sections 11 because of the sleeves 15. Assembly is rendered most convenient because screws and the like are not required.

A safe, very strong, convenient and economical trampoline structure is achieved by the invention and it also possesses unique eye appeal which is always important.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A trampoline comprising a perimeter frame consisting of plural identically-shaped and sized frame sections adapted in assembled relationship to form a continuous perimeter frame disposed in one plane, plural support legs for the perimeter frame corresponding in number to said frame sections of the perimeter frame and being shaped and sized identically to said frame sections, and releasable connector means on each support leg engageable with corresponding end portions of adjacent pairs of said perimeter frame sections to join such sections in said one plane and to secure each support leg to one perimeter frame section dependingly in a plane substantially perpendicular to said one plane, and said connector means comprising plural spaced coaxial sleeves fixed to the top of each support leg and receiving telescopically therein the corresponding end portions with the latter in coaxial relationship, said sleeves and end portions having engaging flat faces resisting relative rotation of the sleeves and end portions.

2. In a trampoline as defined in claim 1, and said perimeter frame being octagonal and the perimeter frame sections being identical quarter octagonal sections which are polygonal in cross section, said sleeves being of mating polygonal cross section.

3. In a trampoline as defined in claim 1, and said perimeter frame being a polygonal frame, and each of said frame sections and support legs comprising fractional portions of the polygonal frame and having connected bar sections disposed at angles one to another.

4. In a trampoline as defined in claim 1, and a trampoline mat including multiple radiating suspension springs disposed inside of the perimeter frame with outer terminals of the springs connected to the perimeter frame, whereby the springs bias the perimeter frame, sections toward their assembled relationship.

5. In a trampoline as defined in claim 1, and said connector sleeves and corresponding end portions being square in cross section.

6. A trampoline comprising a multi-section perimeter frame in which all of the sections have the same size and configuration and all include an intermediate bar section, plural support legs for the perimeter frame disposed in planes perpendicular to the perimeter frame, each support leg including a bar member directly underlying said intermediate bar section of each section of the perimeter frame, three spaced coaxial connector sleeves fixed to the top of said bar member of each support leg and corresponding end bar sections of each perimeter frame section being engaged telescopically within said connector sleeves and having their ends terminating inside of one such sleeve which is arranged intermediate the other two of said three spaced coaxial connector sleeves.

7. A trampoline as defined in claim 6, and each support leg being identical in size and configuration to one section of the perimeter frame.

8. A trampoline as defined in claim 7, and said connector sleeves and end bar sections engaged telescopically therein being polygonal in cross section.

9. A trampoline as defined in claim 6, and a trampoline mat within the confines of the perimeter frame including multiple mat suspension springs connected with the perimeter frame sections and pulling such sections toward the center of the trampoline to thereby hold the sections in assembled relationship without the necessity for separable fasteners.

10. A frame comprising a plurality of identical frame sections which in assembled relationship form a continuous perimeter frame lying in one plane, plural support legs for the perimeter frame each being formed identically to said frame sections, and connector elements fixed coaxially to the top of each support leg and adapted to receive corresponding end portions of adjacent pairs of said frame sections with the latter in coaxial relationship, said elements and end portions having engaging flat faces resisting relative rotation of the sleeves and end portions.

11. In a frame as defined in claim 10, and said connector means comprising connector sleeves fixed coaxially to the top of each support leg and adapted to receive telescopically said corresponding end portions with the latter in coaxial end-to-end relationship, said sleeves and end portions having engaging flat faces to resist relative rotation of the sleeves and end portions when in assembled relationship.

* * * * *